United States Patent [19]

Bollenbach

[11] 3,969,191

[45] July 13, 1976

[54] CONTROL FOR REGENERATORS OF A HORIZONTAL COKE OVEN

[75] Inventor: Gunther Bollenbach, Herne, Germany

[73] Assignee: Dr. C. Otto & Comp. G.m.b.H., Bochum, Germany

[22] Filed: May 30, 1974

[21] Appl. No.: 474,374

[30] Foreign Application Priority Data

June 1, 1973 Germany ..... 2327983

[52] U.S. Cl. ..... 202/141

[51] Int. Cl.[2] ..... C10B 5/12

[58] Field of Search ..... 202/141, 146, 142, 143, 202/144

[56] References Cited

UNITED STATES PATENTS

| | | | |
|---|---|---|---|
| 2,216,983 | 10/1940 | Otto | 202/142 |
| 2,872,385 | 2/1959 | Hartewig et al. | 202/141 |
| 3,183,175 | 5/1965 | Breitbach et al. | 202/141 X |
| 3,196,086 | 7/1965 | Wethly | 202/142 |
| 3,252,872 | 5/1966 | Grumm | 202/141 |
| 3,838,017 | 9/1974 | Messerschmidt | 202/141 |

FOREIGN PATENTS OR APPLICATIONS

| | | | |
|---|---|---|---|
| 1,078,995 | 4/1960 | Germany | 202/141 |
| 699,505 | 11/1953 | United Kingdom | 202/141 |

*Primary Examiner*—Joseph Scovronek
*Assistant Examiner*—Arnold Turk
*Attorney, Agent, or Firm*—Brown, Murray, Flick & Peckham

[57] ABSTRACT

In a horizontal coke oven, the regenerators therefor include columns of superimposed checkerbricks supported at their lower ends on horizontal partitions forming stationary ports that conduct gaseous media between an underlying sole flue and the various sections of the regenerator. Movable plates with portal openings contiguous with the stationary ports are adjustable in the direction of the length of the sole flues for determining the extent to which the stationary ports are masked by the plate. Grooves are formed at the underside of the stationary ports for guiding the side edges of the movable plates. Pegs extend from the lower surface of the plates. In one embodiment, trough-shaped support members in the sole flue carry an adjusting rod that extends along the flue from the coke discharge side of the oven. Fingers extend radially from the rod to engage the pegs to move the plates in an adjustable manner. In a second embodiment, vertically-arranged rods extend from the cellar of an underjet fired oven through the roof of the cellar into the sole flues where the end of the rods carry forked guide members to engage the pegs projecting from the undersurface of the movable plates.

7 Claims, 11 Drawing Figures

CONTROL FOR REGENERATORS OF A HORIZONTAL COKE OVEN

BACKGROUND OF THE INVENTION

This invention relates to a horizontal coke oven having cross regenerators for heat exchange between gaseous combustion supporting agents and the burnt gases. Each regenerator has a sole flue for the supply and removal of the gaseous media and the sole flue communicates with various vertical sections of the regenerator by way of horizontal partitions forming stationary ports. The present invention is specifically addressed to apparatus for the variable distribution of combustion supporting gases through the stationary ports to discrete vertical sections of the regenerators.

One of the biggest problems in the art of heating coke ovens having cross regenerators is how to distribute, in a suitable manner for the particular form of coke oven operation to be undertaken, the gaseous combustion supporting media to the vertical regenerator sections associated with the various heating flues or groups of the heating flues. The vertical regenerator sections are highly subdivided by vertical partitions which form regenerator cells that are allotted to various parts of the heating wall in the coke oven.

In one known coke oven design, a ported stationary partition which extends over the whole length of the sole flue, is disposed between the sole flue and the regenerator which forms one-half of the heating wall. A plate with portal opening can be moved lengthwise of the channel and is so disposed as to be in direct contact with the stationary partition. The masking of the ports in the stationary plate or partitions varies in accordance with the manner in which the adjustable or movable plate is moved along the sole flue. A facility of this kind has the disadvantage that it is possible to vary the heating of only the entire regenerator. It cannot provide graded heating of discrete vertical sections of the regenerator.

It is also known in the art in regard to horizontal coke ovens to provide a row of plates having ports of different sizes to be disposed between the cross-regenerator and the sole flue. Each such plate being allocated to a particular vertical regenerator section. The plates are carried on supports disposed in the top part of the sole flue. Distribution of the gaseous agents to the discrete vertical regenerator sections can be varied as required at any time by exchanging the various plates for other plates having ports of different sizes. In this operation however, all the plates must be removed seriatim from the coke side of the oven. One or more plates removed in this manner are replaced and the plates are interconnected in a manner that they are not individually movable lengthwise. The plates are then introduced consecutively into the sole flue.

SUMMARY OF THE INVENTION

It is an object of the present invention to achieve a simplified, very accurate and operationally variable distribution of gaseous combustion supporting agents to discrete vertical sections of cross regenerators of a horizontal coke oven.

In accordance with the present invention there is provided individual and movable plates with portal openings such that each plate is associated with a vertical regenerator section and disposed directly at the underside of a ported stationary horizontal partition, preferably in the form of a metal plate, whereby the movable plates associated with each vertical regenerator section can be moved lengthwise in the sole flue. The position of each movable plate determines the extent to which the ports of the stationary partition are masked. The movable plates each function as a regulating or control plate that can be adjusted independently of its neighboring plate. The space between the individual plates must be large enough to insure that the plates do not interfer with one another within their zone of movement.

In the preferred form of the present invention, the movable plates are guided by providing longitudinal grooves at both sides of the movable plates for guiding the side edges of the plates at the underside of the stationary partition. Pegs extend downwardly from the underside of the movable plates and form the means to engage the plates so that they can be moved lengthwise. In the case of an underjet fired oven, the movable plates can be individually positioned by separate adjusting means adapted to be operated from the cellar located below the sole flue. The adjusting means is operated by vertical rods which extend through passageways in the cellar roof. The rods carrying the adjusting means can remain permanently in the oven in which case a gas-tight seal within the passageway in the cellar roof is provided. However, each passageway in the roof can have a removable bottom closure and the adjusting means can be introduced through the passageway made available only when it is required to adjust the movable plates.

According to another feature of the present invention, there is provided different type of means for adjusting the movable plates in the form of a rod which is introducable into the sole flue. The rod is carried on stationary trough-like support members so that it can rotate about its longitudinal axis. The rod can be moved lengthwise of the sole flue and operated from the coke side of the oven. The rod has radial fingers adapted to engage the afore-described pegs at the underside of the movable plates.

In the manner known in regard to prior art forms of control plates, the rod can be made up of a number of longitudinal sections which can be so interconnected as to be solid with one another for longitudinal and rotational movements. This enables the rod to be introduced gradually along the entire length of the sole flue from the coke side of the oven.

To facilitate the introduction of the rod into the sole flue for adjusting the various movable plates, a free space is provided in the sole flue between an interconnecting pipe and the stationary partitions. This free space is closed off at the coke side of the oven by a metal cover adapted for removal during the entry and operation of the rod employed to adjust the movable plates.

If required, however, an adjusting rod of this kind can be left in the sole flue permanently. The radially extending fingers on the adjusting rod which correspond in number to the various vertical regenerator sections can be so distributed angularly about the rod that at a given position of rotation of the rod about its longitudinal axis that a peg of a given adjustable plate is engaged for the adjustment thereof. The end of the adjusting rod which extends outwardly of the sole flue can be provided with a disc having markings to show the angle of rotation of the rod and the vertical regenerator section to be adjusted.

This novel form of control for the supply and removal of combustion supporting media through the sole flue helps to alleviate any unwanted equalization between the inputs of the various vertical regenerator sections in the case of a checkerbrick of the kind typically employed in the OTTO type of coke ovens. In such a checkerbrick, the longitudinal and transverse walls bound within them continuous passages of oblong cross-section and the outer walls of the bricks have projecting ribs bounding spaces engaged by the projections of the bricks above and below. According to the present invention for a hermetic closure of the various vertical regenerator sections, the checkerbricks engage the top of the stationary partition by way of depending ribs at the bottom of the lowermost checkerbrick of the regenerators.

These features and advantages of the present invention as well as others will be more apparent when the following description is read in light of the accompanying drawings of which:

Figure 1:
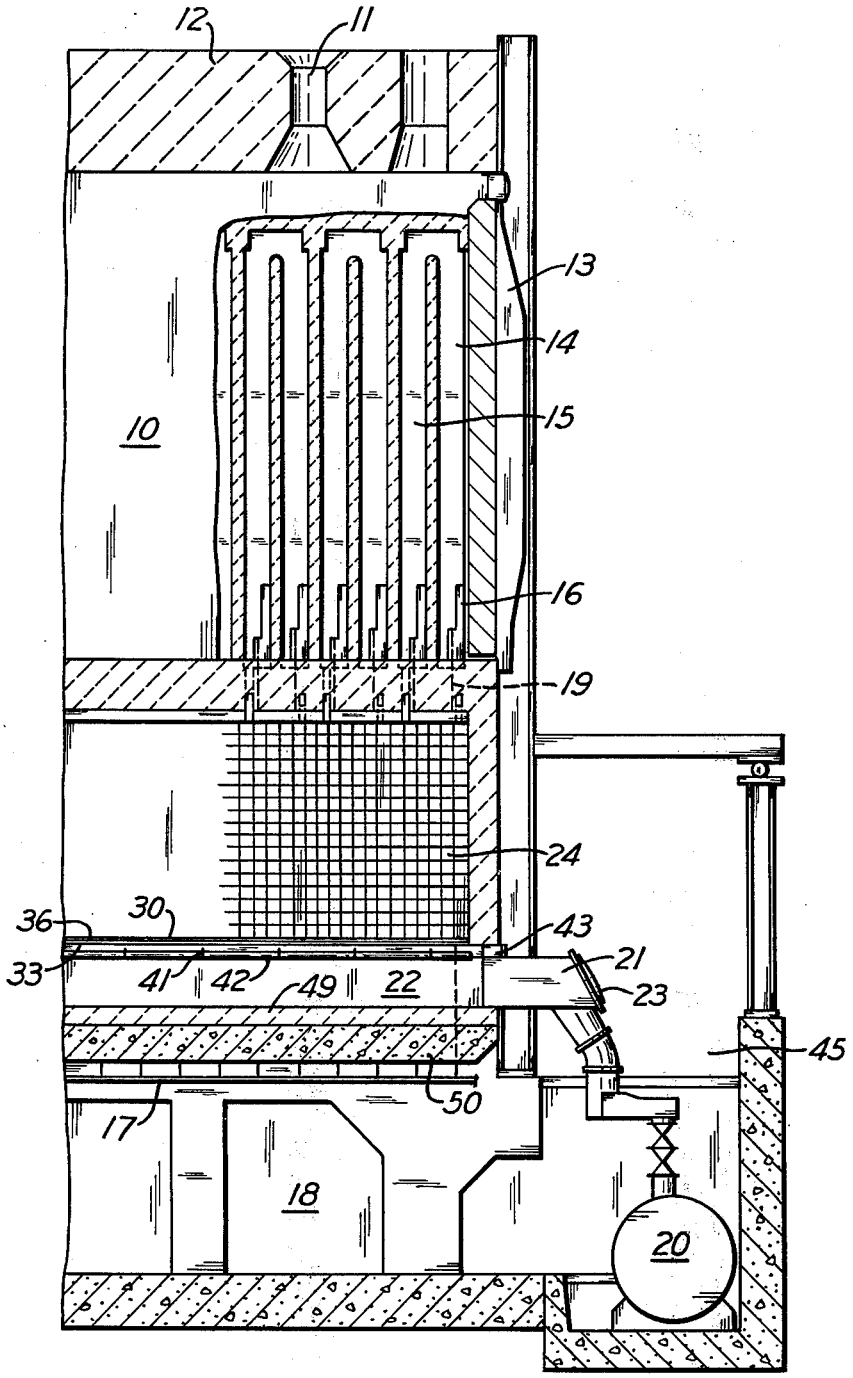
FIG. 1 is a vertical longitudinal section through the center of an oven chamber forming part of a battery of coke ovens of the underjet fired type and further illustrating a row of heating flues.

FIG. 1 illustrates a horizontal coke oven chamber 10 forming part of a battery of coke ovens. As is the usual practice, the oven chambers and rows of heating flues alternate along the coke oven battery. The oven chamber 10 is charged with coal through the charge hole 11 in the oven roof 12. Oven doors 13 close the opposite ends of the coke oven chamber and the door shown in FIG. 1 is at the coke discharge side of the oven chamber. In FIG. 1 a broken away portion of the oven chamber illustrates two adjacent flues 14 and 15 communicating with one another at the top of the flue and cooperate with the alternative operation for regenerative heating of the oven chamber. Heating of the oven chamber using rich gas is provided by means of burner 16 which receives the rich gas conducted through lines 19 from nozzle lines 17 disposed in a cellar 18. The cellar is located below the oven chamber. The lines 19 extend vertically upward through partitions of the regenerator. When heating the oven chamber with lean gas, a distribution line 20 is provided which is controllably connected to an inlet pipe 21 arranged to extend a short distance into the regenerator sole flue 22. All the pipes 21 for the battery of coke ovens and not just those pipes associated with the supply of air to the regenerators have slats or flaps 23.

Figure 3:
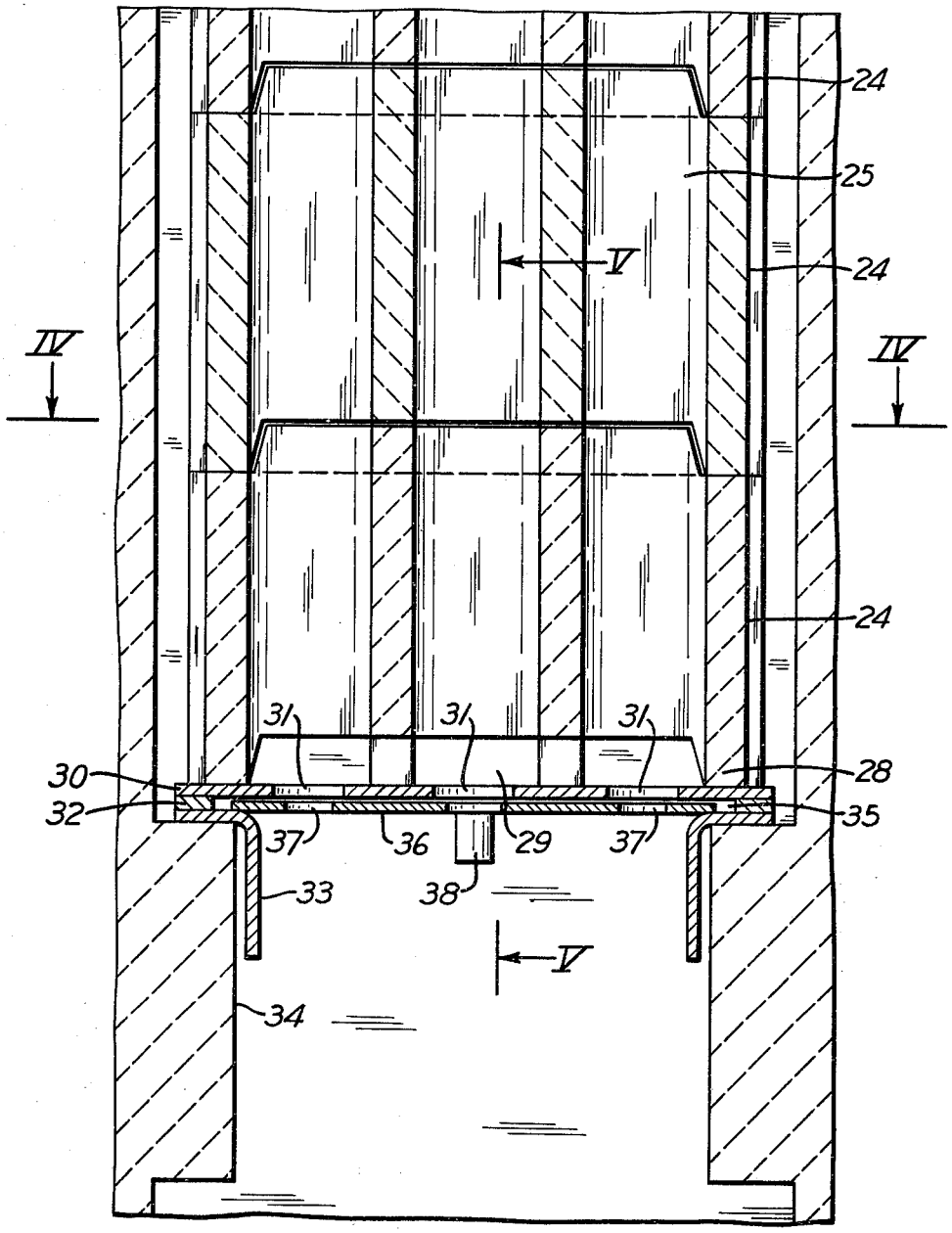
FIG. 3 is an enlarged sectional view taken along lines III—III of FIG. 2.
Figure 4:
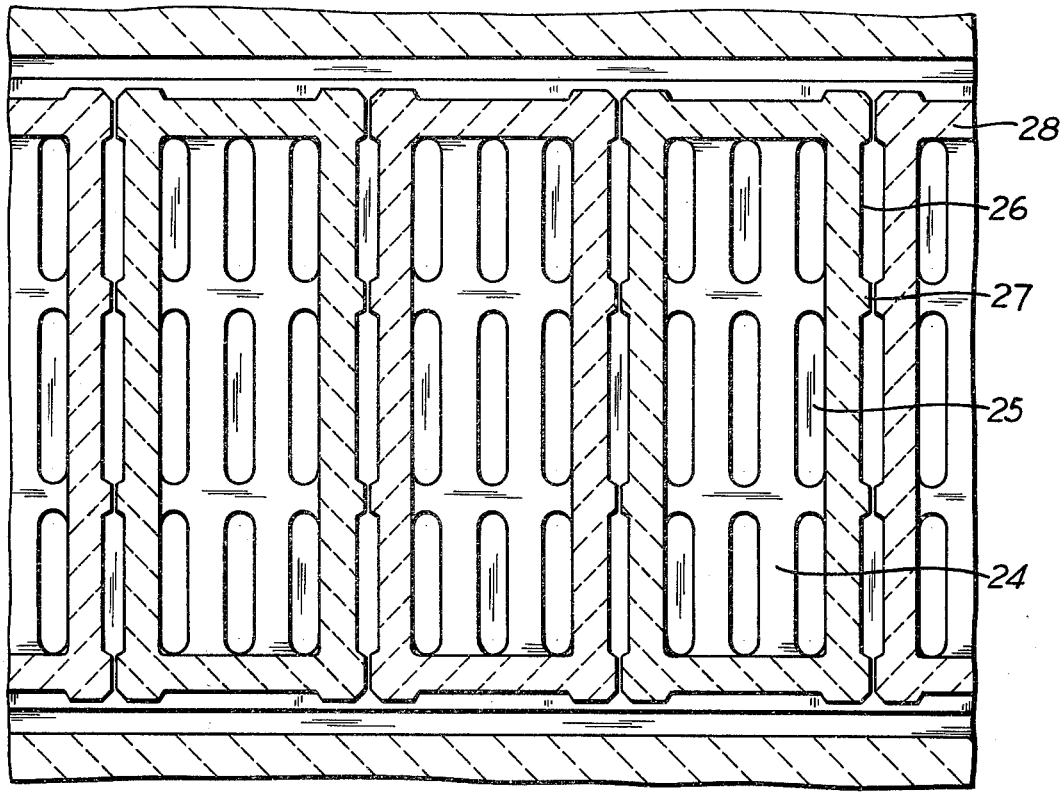
FIG. 4 is a horizontal sectional view taken along lines IV—IV of FIG. 3.

The regenerators have fillings of checkerbricks 24 whose shape can best be observed in regard to the illustrations by FIGS. 3 and 4. The longitudinal and transverse walls of the bricks 24 bound continuous and substantially oblong-section chambers 25. The outer walls 26 of the brick are formed with ridges 27 extending perpendicularly therefrom and bound between the adjacent bricks, spaces or chambers whose horizontal cross-section is similar to that of the innerspaces or chambers 25. The spaces between the bricks are continuous along the column of superimposed checkerbricks. The outer walls of the bricks extend to define depending ribs 28 that surround a space 29 that is engagable with a projection extending from the top surface of the brick arranged below it.

The features and advantages of the present invention provide a solution to the problem of distributing the gaseous agents which are required to undergo a preheating. The invention provides a distribution of these agents from the sole flue 22 to the various vertical regenerator sections. Every pair of flues makes up one such vertical regenerator section. In the embodiments shown by FIGS. 1–6 and 7–9 a section of a vertical regenerator consists of six columns of checkerbricks wherein the bricks of each column are placed one above the other in a superimposed relation.

The problem which is solved by the present invention is addressed to, in the coke oven operation, distributing the gaseous agents from the regenerator sole flue to discrete vertical regenerator sections such that each individual pair of flues receives precisely the amount of combustion supporting agents that is needed by such sections. The amount of such agents varies from one pair of flues to another pair of flues depending upon the narrowing of the oven chamber from coke side toward the machine side, upon radiation losses from the oven and upon other factors.

According to the present invention, a stationary ported wall is provided between the regenerator sole flue 22 and the regenerator. In both embodiments of the present invention such a wall for the coke ovens illustrated takes the form of a sheetlike metal plate 30 formed with ports 31. The ribs 28 of the bottom layer of bricks 24 rest directly on the plate 30. The plate 30 is, in turn, carried along its side edges by spacer members 32 which rest on horizontal arms of angle members 33, all of which are supported by wall projection 34 of the sole flue 22.

The angle members 33 cooperate with the plate 30 to form with the members 32 longitudinal grooves 35 by which various adjustable plates 36 forming the main feature of the present invention are guided along their side edges. The plates 36 have ports 37 corresponding to the ports 31 in the stationary plates 30. The ports 31 can be brought into varying degrees of registration with the ports 37 by separate movement of each plate 36 in the direction of its length. The length of each plate 36 corresponds to the length of the regenerator section which supplies a pair of flues. In other words, the length of the plate 36 corresponds approximately to the length of six checkerbricks 24 less a small distance to leave sufficient space for the adjustment of the plates lengthwise of the sole flue 22. The adjustable plates are positioned to control the free cross sectional area for the passage of the gaseous agents, that require preheating, from the sole flue into the regenerator and conversely for the passage of burnt gases from the regenerator into the sole flue 22. This is very apparent by viewing FIG. 5 where the adjustable plate 36 is illustrated in the central position in which the ports 31 of the fixed plate 30 are only partially cleared by the ports 37 of the adjustable plate 36 associated with the regenerator section being controlled thereby. It is thus apparent that a plurality of plates 36 are actually provided for the coke ovens and numerous possibilities are available for adjusting the various positions of the plates to control the passage of the gaseous media through the openings in the plates.

Figure 5:
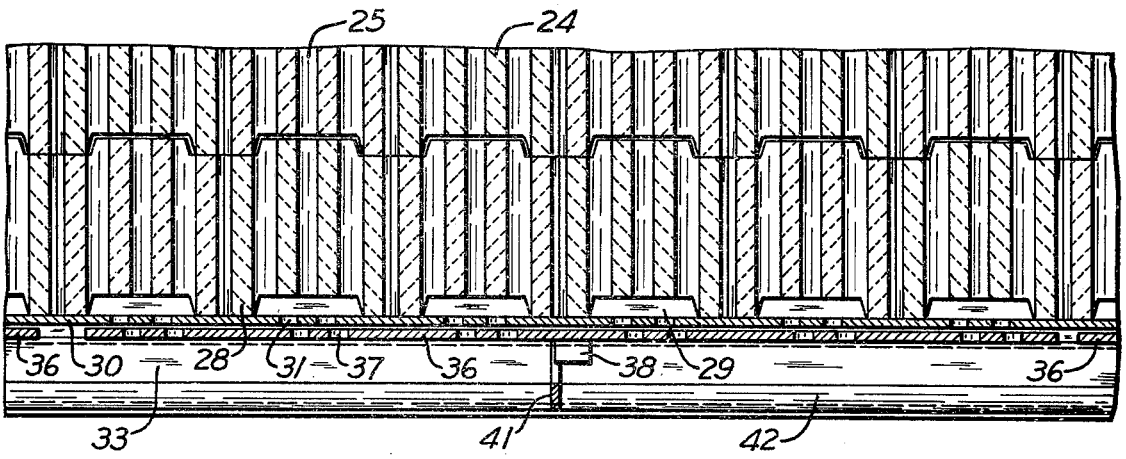
FIG. 5 is a sectional view taken along lines V—V of FIG. 3.
Figure 6:
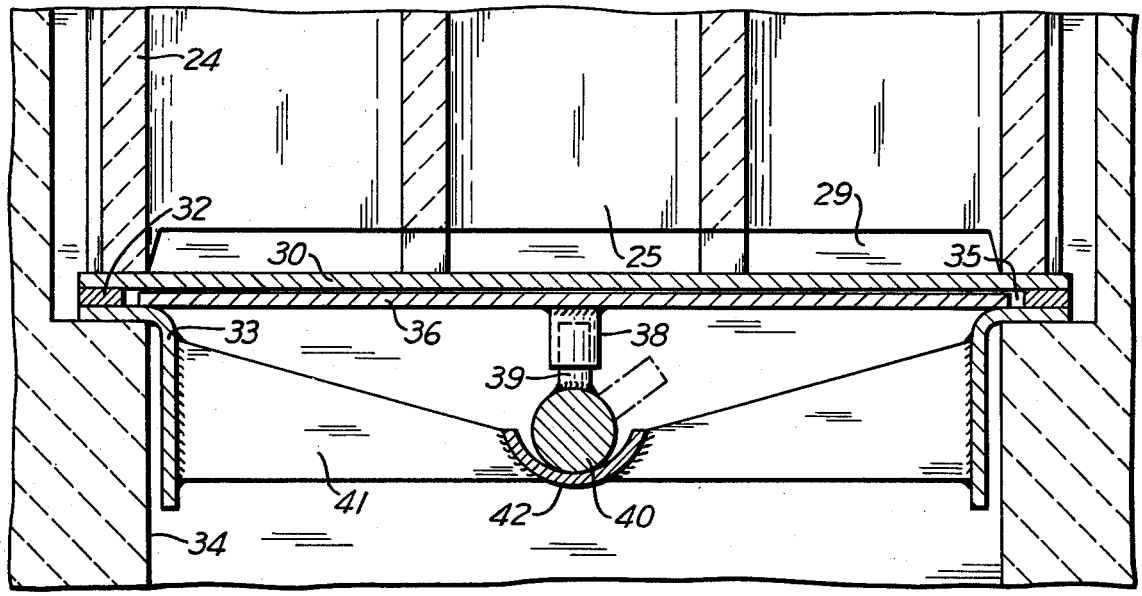
FIG. 6 is an enlarged view similar to FIG. 3 and illustrating the support arrangement for the adjusting rod to position the movable plates according to the present invention.

In one embodiment, as illustrated in FIGS. 3, 5 and 6, pegs 38 are conveniently welded to the underside of the plates 36. To adjust the position of the plates 36, the pegs 38 are so constructed and arranged for engagement by fingers 39 extending radially from a rod 40 that is adapted for introduction into the sole flue 22. As illustrated in FIG. 6, arms 41 are welded to the vertical arm portion of the angle members 33. The arms 41 carry trough-shaped supports 42 for guiding the rod 40 at spaced locations throughout the length of the sole flue 22.

Figure 2:
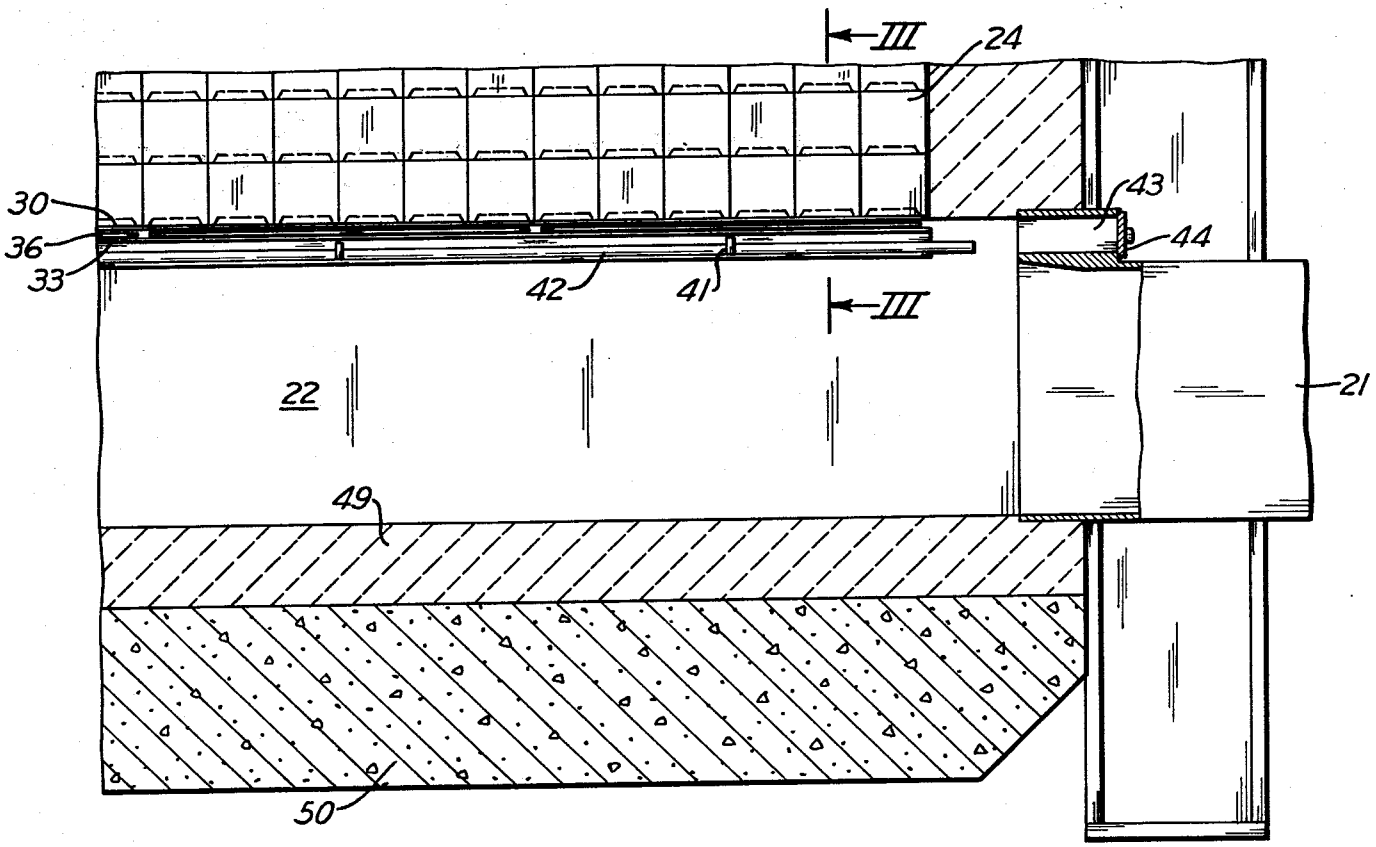
FIG. 2 is an enlarged view similar to FIG. 1 and illustrating the regenerator sole flue in its connection with a pipe for the introduction of combustion supporting air which is to be preheated.

Between the pipe 21 and the top edge of the sole flue 22 there is a free space 43 as clearly illustrated in FIG. 2. A removable cover 44 forms a closure for the space 43. After the cover 44 has been removed, the rod 40 can be introduced into the space 43 along the flue for adjusting the position of the movable plates 36. The rod 40 may actually consist of a plurality of rod sections connected together, in a solid manner, in an end-to-end relation to move with one another in a lengthwise and rotational direction. In this way, rod sections can be successively connected together at the bench 45 at the coke side of the oven and as the rod is gradually introduced into the sole flue from the bench 45. The rod can be conveniently provided with markings to indicate the location, along the length of the rod, of the fingers 39 so that the operator can be accurately informed as to exactly where a peg 38 can be acted upon or engaged by the fingers 39. In other words, the operator is informed as to which vertical regenerator section he is adjusting the movable plate by engaging a peg 38 associated therewith.

Figure 8:
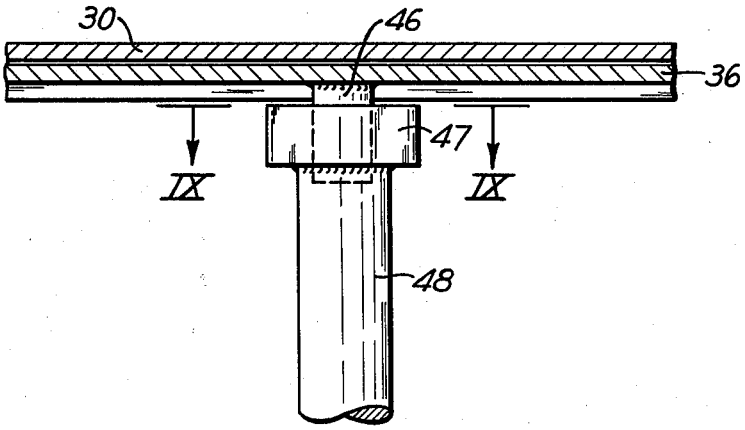
FIG. 8 is an enlarged view of the modified form of means for adjusting the movable plates shown in FIG. 7.
Figure 9A:
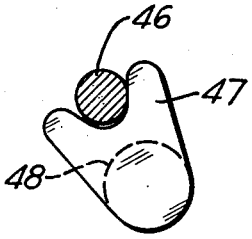
FIGS. 9A, 9B and 9C are sectional views taken along lines IX—IX of FIG. 8 and illustrating the various positions of the adjusting means according to the second embodiment of the present invention.
Figure 9B:
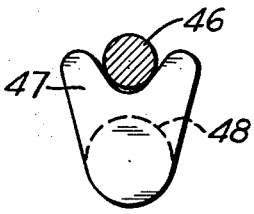
Figure 9C:
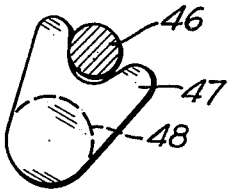
Figure 7:
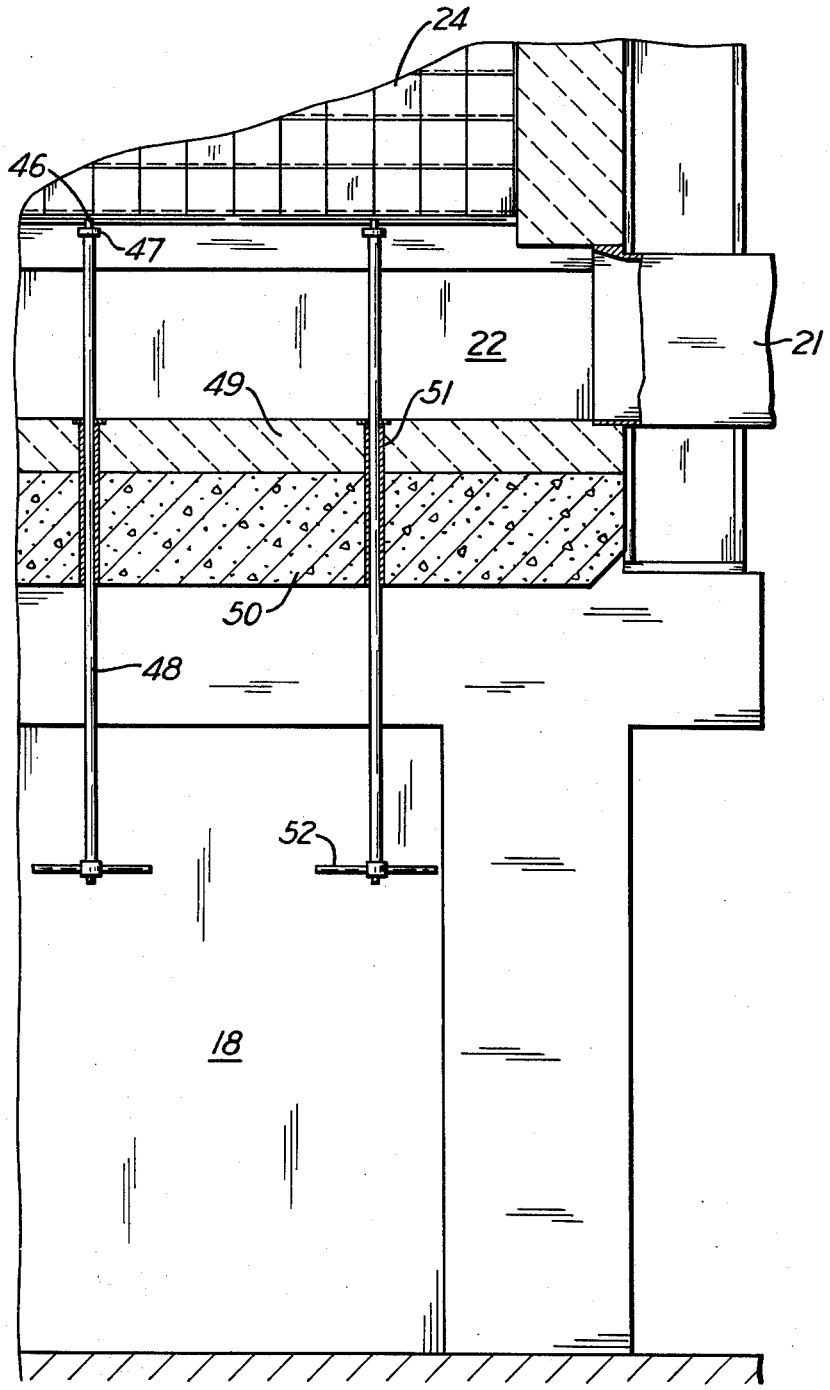
FIG. 7 is a view similar to FIG. 1 and illustrating a second embodiment of the present invention in regard to the means for adjusting the movable plates.

FIGS. 7–9 illustrate a different form of device for adjusting the position of the movable plates for an underjet fired oven. As illustrated, the movable plate 36 has at its underside surface a peg 46 that is round in cross section. The peg 46 is designed for engagement with a fork-like guide member 47 connected to the upper end of a vertical rod 48. The rod 48 extends from the cellar 18 through a passageway in the roof thereof where a seal 51 extends in the base 41 of the sole flue 22 and extends in a concrete slab 50. A grip 52 is provided at the lower end of the vertical rod 48. The rod 48 can be easily provided with a scale which will indicate the position of the plate 36 and the extent of the registry between the ports in the movable plate 36 and the stationary plate 30.

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. In a horizontal coke oven having vertical regenerators for heat exchange between combustion supporting gases and burnt gases, a sole flue communicating with said vertical regenerators for the supply and removal of gaseous media, and a stationary horizontal partition having ports therein for the conduction of the gaseous media between the sole flue and various sections of said vertical regenerators which include fillings of checkerbricks having longitudinal and transverse walls that bound continuous passages of oblong cross section, the outer walls of said checkerbricks having projecting ribs engageable with the projections of the checkerbricks above and below, the improvement comprising a plurality of plates arranged end-to-end in a gaseous controlling relation below said stationary horizontal partition with adjacent ends of the plates being normally spaced from each other, each of said plates being associated with a different one of discrete various sections of the vertical regenerators, said plates having portal openings contiguous with the stationary ports of said horizontal partition, ribs depending from the lowermost checkerbrick in each section for engaging the top surface of said stationary horizontal partition, said plates being independently adjustable in the direction of the length of the sole flues for determining the extent to which said ports of the stationary horizontal partition are masked by said plates, and means extending downwardly from the underside of said plurality of plates for separate adjustable movement thereof.

2. A horizontal coke oven according to claim 1 wherein said means include pegs extending downwardly from the underside of said plates for adjustable movement of said plates, the improvement further comprises means defining longitudinal grooves at the underside of said stationary partitions for guiding the side edges of said plates.

3. A horizontal coke oven according to claim 2 wherein the improvement further comprises, trough-shaped support members in said sole flue, an adjusting rod carried on said support members and extending from the coke discharge side of said oven for pivotal movement about the longitudinal axis of the rod to adjust the longitudinal position of said plates, and fingers extending radially from said rod for engaging said pegs incident to adjusting the position of the plates.

4. A horizontal coke oven according to claim 3 wherein said adjusting rod includes a plurality of rod sections rigidly connectable together in an end-to-end relation for extending along the length of said sole flue from the coke discharge side of the coke oven.

5. A horizontal coke oven according to claim 1 wherein the improvement further comprises a pipe connected to the end of the sole flue at the coke discharge side of the coke oven, said pipe having a cover plate closing an opening in said pipe, and a rod extendible through the opening exposed by removing said cover plate for adjusting the longitudinal position of said plates.

6. A horizontal coke oven according to claim 1 wherein said coke oven is further characterized as an underjet fired oven having a cellar below said sole flue, and wherein the improvement further comprises, a plurality of vertically arranged rods extending at spaced-apart locations from said cellar through the roof thereof into said sole flue for engaging said means to adjust the position of said plates.

7. A horizontal coke oven according to claim 6 further comprising a guide member secured to an end of each rod, said means extending downwardly from the underside of said plurality of plates further including pegs extending downwardly from the underside of said plates for engagement by a guide member of a rod to adjustably move said plates.

* * * * *